US009511973B2

(12) United States Patent
Ando et al.

(10) Patent No.: US 9,511,973 B2
(45) Date of Patent: Dec. 6, 2016

(54) SHEET STACKING APPARATUS HAVING TRAY THAT IS LIFTED AND LOWERED AND IMAGE FORMING APPARATUS

(71) Applicant: CANON KABUSHIKI KAISHA, Tokyo (JP)

(72) Inventors: Yutaka Ando, Toride (JP); Mitsuhiko Sato, Kashiwa (JP); Takashi Yokoya, Kashiwa (JP); Hiromasa Maenishi, Matsudo (JP); Akihiro Arai, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/683,413

(22) Filed: Apr. 10, 2015

(65) Prior Publication Data

US 2015/0307308 A1 Oct. 29, 2015

(30) Foreign Application Priority Data

Apr. 25, 2014 (JP) ..... 2014-091348

(51) Int. Cl.

| | |
|---|---|
| ***B65H 31/18*** | (2006.01) |
| ***B65H 31/10*** | (2006.01) |
| ***B65H 31/24*** | (2006.01) |
| ***B65H 43/06*** | (2006.01) |
| ***G03G 15/00*** | (2006.01) |

(52) U.S. Cl.

CPC ..... *B65H 31/10* (2013.01); *B65H 31/18* (2013.01); *B65H 31/24* (2013.01); *B65H 43/06* (2013.01); *G03G 15/55* (2013.01); *G03G 15/6538* (2013.01); *B65H 2220/11* (2013.01); *B65H 2405/111* (2013.01); *B65H 2405/15* (2013.01); *B65H 2511/51* (2013.01); *B65H 2511/515* (2013.01); *B65H 2511/521* (2013.01); *B65H 2511/526* (2013.01); *B65H 2513/514* (2013.01);

(Continued)

(58) Field of Classification Search

CPC ..... B65H 31/10; B65H 31/18; B65H 31/24; B65H 43/06; B65H 43/08; G03G 15/6552

See application file for complete search history.

(56) References Cited

U.S. PATENT DOCUMENTS

| | | | | |
|---|---|---|---|---|
| 6,378,860 B1 * | 4/2002 | Gutierrez | ..... | B65H 31/10 271/176 |
| 6,736,393 B2 * | 5/2004 | Noh | ..... | B65H 31/10 271/214 |
| 2011/0031678 A1 * | 2/2011 | Iizuka | ..... | B65H 31/10 271/3.16 |

FOREIGN PATENT DOCUMENTS

| | | | |
|---|---|---|---|
| JP | 2001226022 A | * | 8/2001 |
| JP | 2007062921 A | | 3/2007 |
| JP | 2013091556 A | * | 5/2013 |

* cited by examiner

*Primary Examiner* — Luis A Gonzalez

(74) *Attorney, Agent, or Firm* — Rossi, Kimms & McDowell LLP

(57) ABSTRACT

A sheet stacking apparatus for performing post-processing on sheets received from an image forming apparatus and discharging the processed sheets. A stacking tray has the received sheets stacked thereon. A CPU controls a tray lifting/lowering motor to drive the stacking tray to be lifted or lowered. The CPU determines a vertically moving state of the stacking tray. When the stacking tray is not lowered though the tray lifting/lowering motor is controlled to lower the stacking tray, the CPU notifies the image forming apparatus that a job should be suspended. After notifying, the CPU controls the tray lifting/lowering motor to lift the stacking tray. Then, when the stacking tray can be lifted, the (Continued)

CPU notifies the image forming apparatus that the job is to be resumed.

14 Claims, 15 Drawing Sheets

(52) U.S. Cl.
CPC . *B65H 2801/06* (2013.01); *G03G 2215/00911* (2013.01)

SHEET STACKING APPARATUS HAVING TRAY THAT IS LIFTED AND LOWERED AND IMAGE FORMING APPARATUS

BACKGROUND OF THE INVENTION

Field of the Invention

The present invention relates to control of lifting and lowering of a tray on which sheets are stacked.

Description of the Related Art

Conventionally, there has been known a sheet processing apparatus for performing post-processing, such as punching, stapling, and sorting, on sheets conveyed from an image forming apparatus, such as a copying machine.

Further, in Japanese Patent Laid-Open Publication No. 2007-062921, there has been proposed a sheet processing apparatus that performs post-processing on sheets conveyed from an image forming apparatus and then discharges the sheets such that the sheets are stacked on a stacking tray. The sheet processing apparatus lifts or lowers the stacking tray according to the number of the sheets stacked on the stacking tray.

However, the sheet processing apparatus sometimes suffers from the following problem: The stacking tray projects outward from the apparatus body, and hence an obstacle may be placed e.g. on a floor below the stacking tray. Assuming that there is an obstacle 1400 below a stacking tray 7000, as shown in FIG. 14, when the stacking tray 7000 is lowered, the obstacle 1400 interferes with the stacking tray 7000, which prevents further lowering of the stacking tray 7000.

In this case, it is impossible to discriminate whether the lowering of the stacking tray 700 has been prevented by the interference of the obstacle 1400 or by failure of a motor for driving the stacking tray 7000. For this reason, it is not appropriate to continue a job, and therefore the job has to be temporarily stopped. As a consequence, the job cannot be resumed until a user notices the interruption of the job, performs an appropriate recovery operation, and then instructs the image forming apparatus to resume the job. Thus, downtime continues until the resumption of the job.

In a case where it is not due to motor failure that the stacking tray 7000 cannot be lowered, it is sometimes possible to execute a job if it becomes possible to lower the stacking tray 700 e.g. by removal of products from the stacking tray 700.

Conventionally, however, even when it was not due to motor failure that the stacking tray 700 could not be lowered, and also it becomes possible to resume the job, the image forming apparatus cannot detect this, and a user cannot immediately notice the same either. For this reason, a wastefully long downtime can occur.

SUMMARY OF THE INVENTION

The present invention provides a sheet stacking apparatus which is capable of providing notification of resumption of a job, which has been suspended due to inability to lower a stacking unit, when it is determined, through an attempt to lift the stacking unit, that the job can be resumed, and an image forming apparatus.

In a first aspect of the invention, there is provided a sheet stacking apparatus on which sheets received from an image forming apparatus are stacked, comprising a stacking unit that stacks sheets thereon a drive unit configured to drive the stacking unit to be lifted and lowered, a determination unit configured to determine a lifted or lowered state of the stacking unit, and a control unit configured to, in a case where the determination unit determines that the stacking unit is not lowered when the control unit controls the drive unit to lower the stacking unit, notify the image forming apparatus that a job should be suspended, control the drive unit to lift the stacking unit, and in a case where the determination determines that the stacking unit is lifted, notify the image forming apparatus that the job is to be resumed.

In a second aspect of the invention, there is provided a sheet stacking apparatus on which sheets received from an image forming apparatus are stacked, comprising a stacking unit that stacks sheets thereon, a drive unit configured to drive the stacking unit to be lifted and lowered, a determination unit configured to determine a lifted or lowered state of the stacking unit, and a control unit configured to, in a case where the determination unit determines that the stacking unit is not lowered when the control unit controls the drive unit to lower the stacking unit, control the drive unit to lift the stacking unit, and in a case where the determination determines that the stacking unit is not lifted, decide that the drive unit is abnormal, whereas in a case where the determination determines that the stacking unit is lifted, decide that the drive unit is free from abnormality.

In a third aspect of the invention, there is provided an image forming apparatus comprising an image forming unit configured to form an image on a sheet based on an input job, a stacking unit that stacks thereon sheets each having an image formed thereon by the image forming unit, a drive unit configured to drive the stacking unit to be lifted and lowered, a determination unit configured to determine a lifted or lowered state of the stacking unit, and a control unit configured to, in a case where the determination unit determines that the stacking unit is not lowered when the control unit controls the drive unit to lower the stacking unit, suspend the job, control the drive unit to lift the stacking unit, and in a case where the determination determines that the stacking unit is lifted, resume the job.

According to the invention, it is possible to provide notification of resumption of a job, which has been suspended due to inability to lower a stacking unit, when it is determined, through an attempt to lift the stacking unit, that the job can be resumed.

Further features of the present invention will become apparent from the following description of exemplary embodiments (with reference to the attached drawings).

BRIEF DESCRIPTION OF THE DRAWINGS

FIG. 6B is a schematic view of the tray drive sensor and the encoder when the tray drive sensor is ON.

DESCRIPTION OF THE EMBODIMENTS

The present invention will now be described in detail below with reference to the accompanying drawings showing embodiments thereof.

Figure 1:
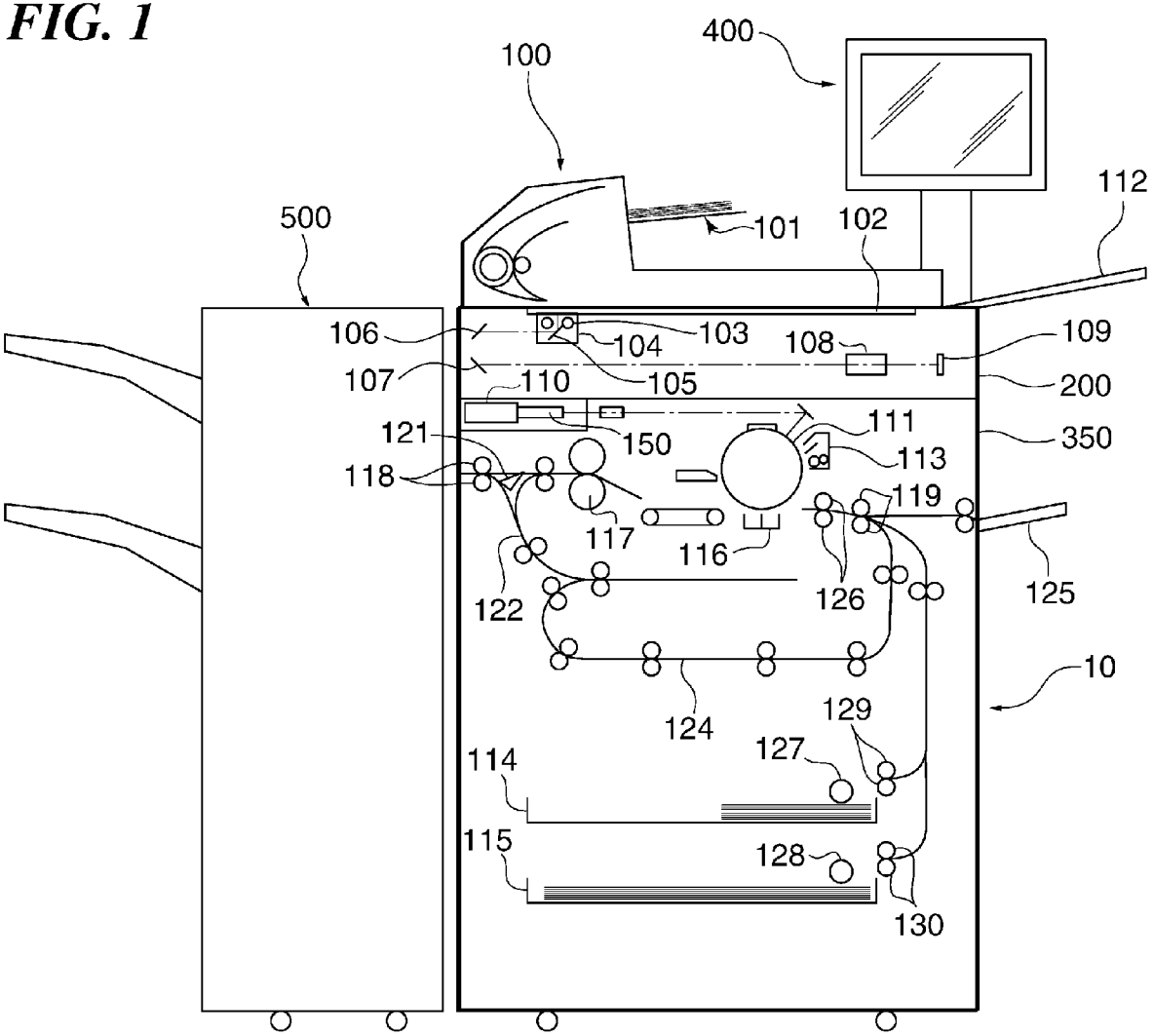
FIG. 1 is a schematic longitudinal cross-sectional view of an image forming system including a sheet stacking apparatus according to a first embodiment of the invention.

FIG. 1 is a schematic longitudinal cross-sectional view of an image forming system including a sheet stacking apparatus according to a first embodiment of the invention. The image forming system is comprised of an image forming apparatus 10 and a finisher 500 as the sheet stacking apparatus connected to downstream side of the image forming apparatus 10.

The image forming apparatus 10 is comprised of an image reader 200 for reading an image from an original, a printer 350 for forming the image read from the original on a sheet, and a console unit 400.

An document feeder 100 of the image reader 200 sequentially feeds originals set on a document tray 101 with their image surfaces facing upward, starting from the leading page, one by one, in the left direction as viewed in FIG. 1, such that each original is conveyed via a curved path through a predetermined reading position on a platen glass 102, from left to right, and is then discharged onto a discharge tray 112.

As each original passes the reading position from left to right on the platen glass 102, an image of the original is read by a scanner unit 104 held in a position corresponding to the reading position. Specifically, as the original passes the reading position, the image surface of the original is irradiated with light from a lamp 103 of the scanner unit 104, and reflected light from the original is guided to a lens 108 via mirrors 105, 106, and 107. Then, light having passed through the lens 108 forms an image on an imaging surface of an image sensor 109.

The optically read image is converted to image data by the image sensor 109 and is output therefrom. The image data output from the image sensor 109 is input as a video signal to an exposure section 110 of the printer 350.

The exposure section 110 of the printer 350 modulates a laser beam based on the video signal input from the image reader 200 and outputs the modulated laser beam. The output laser beam is irradiated onto a photosensitive drum 111 while being scanned by a polygon mirror 150. On the photosensitive drum 111, an electrostatic latent image is formed according to the scanned laser beam. The electrostatic latent image formed on the photosensitive drum 111 is visualized as a developer image (toner image) by a developer supplied from a developing device 113.

On the other hand, a sheet fed from an upper cassette 114 or a lower cassette 115 in the printer 350 via a pickup roller 127 or 128 is conveyed to a registration roller pair 126 by a sheet feed roller pair 129 or 130.

When the leading end of the sheet reaches the registration roller pair 126, the image forming apparatus 10 drives the registration roller pair 126 again to convey the sheet in between the photosensitive drum 111 and a transfer section 116 in timing synchronous with the start of the irradiation of the laser beam. The developer image formed on the photosensitive drum 111 is transferred onto the fed sheet by the transfer section 116. The sheet having the developer image transferred thereon is conveyed to a fixing section 117. The fixing section 117 fixes the developer image on the sheet by heating and pressing the sheet. The sheet having passed the fixing section 117 passes a flapper 121 and a discharge roller pair 118, and is then discharged from the printer 350 onto an external apparatus (i.e. the finisher 500 in the present example).

In a case where the image forming apparatus 10 discharges the sheet face-down, i.e. with an image-formed surface thereof facing downward, the sheet having passed the fixing section 117 is temporarily guided into an inversion path 122 by switching operation of the flapper 121. Then, after the trailing edge of the sheet has passed the flapper 121, the image forming apparatus 10 switches back the sheet and discharges the same from the printer 350 by the discharge roller pair 118.

When an image is to be formed on a firmer sheet, such as an OHP sheet, supplied from a manual sheet feeder 125, the sheet is not guided into the inversion path 122, and hence discharged by the discharge roller pair 118, face-up, i.e. with an image-formed surface thereof facing upward.

Further, when a double-sided printing mode for forming images on both sides of a sheet is set, after the sheet is guided into the inversion path 122 by switching operation of the flapper 121, the sheet is conveyed to a double-sided conveying path 124. Then, the sheet is caused to be fed in again between the photosensitive drum 111 and the transfer section 116 in the aforementioned timing synchronous.

The sheet discharged from the printer 350 is sent to the finisher 500. The arrangement and control of the finisher 500 will be described hereinafter.

Figure 2:
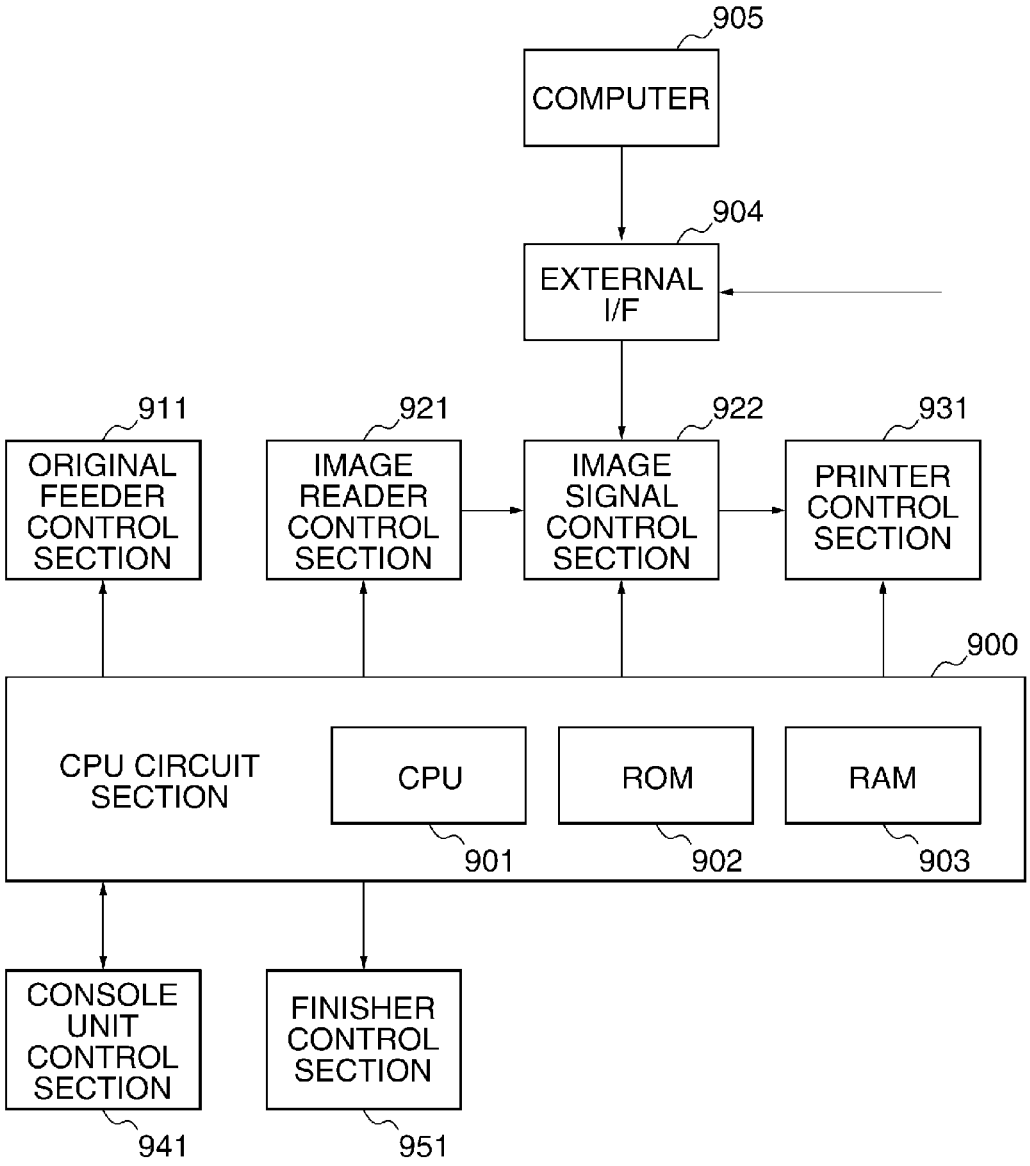
FIG. 2 is a schematic block diagram of a controller.

Next, a description will be given, with reference to FIG. 2, of the arrangement of a controller as a control section for controlling the overall operation of the image forming system shown in FIG. 1. FIG. 2 is a schematic block diagram of the controller.

As shown in FIG. 2, the controller has a CPU circuit section 900, and the CPU circuit section 900 incorporates a CPU 901, a ROM 902, and a RAM 903. The CPU 901 performs basic control of the overall operation of the image forming system. The CPU 901 controls an original feeder control section 911, an image reader control section 921, an image signal control section 922, a printer control section 931, a console unit control section 941, and a finisher control section 951, in a centralized manner by executing control programs stored in the ROM 902. The RAM 903 temporarily stores control data, and is also used as a work area for executing arithmetic operations required for the control operation of the CPU 901.

The original feeder control section 911 drivingly controls the original feeder 100 according to instructions from the CPU circuit section 900. The image reader control section 921 drivingly controls the scanner unit 104, the image sensor 109, and so forth, and transfers an image signal output from the image sensor 109 to the image signal control section 922.

The image signal control section 922 converts the analog image signal from the image sensor 109 into a digital signal, then performs various kinds of processing on the digital signal, converts the processed digital signal into a video signal, and delivers the video signal to the printer control section 931. Further, the image signal control section 922 performs various kinds of processing on a digital image signal input from a computer 905 via an external interface 904, converts the processed digital image signal into a video signal, and delivers the video signal to the printer control section 931. The processing operations performed by the image signal control section 922 are controlled by the CPU circuit section 900. The printer control section 931 performs image forming operation and sheet conveyance by controlling the exposure section 110 and the printer 350 based on the input video signal.

The image forming apparatus 10 and the finisher 500 are communicably connected to each other. The finisher control section 951 is incorporated in the finisher 500, and exchanges information with the CPU circuit section 900 to thereby control the overall operation of the finisher 500. This control operation will be described in detail hereinafter.

The console unit control section 941 controls exchange of information between the console unit 400 and the CPU circuit section 900. The console unit 400 includes a plurality of keys for configuring various functions for image formation, and a display section 420 for displaying information indicative of the configurations. The console unit 400 outputs key signals corresponding to respective operations of keys to the CPU circuit section 900, and displays the corresponding pieces of information on the display section 420 of the console unit 400 based on signals from the CPU circuit section 900.

Figure 3A:
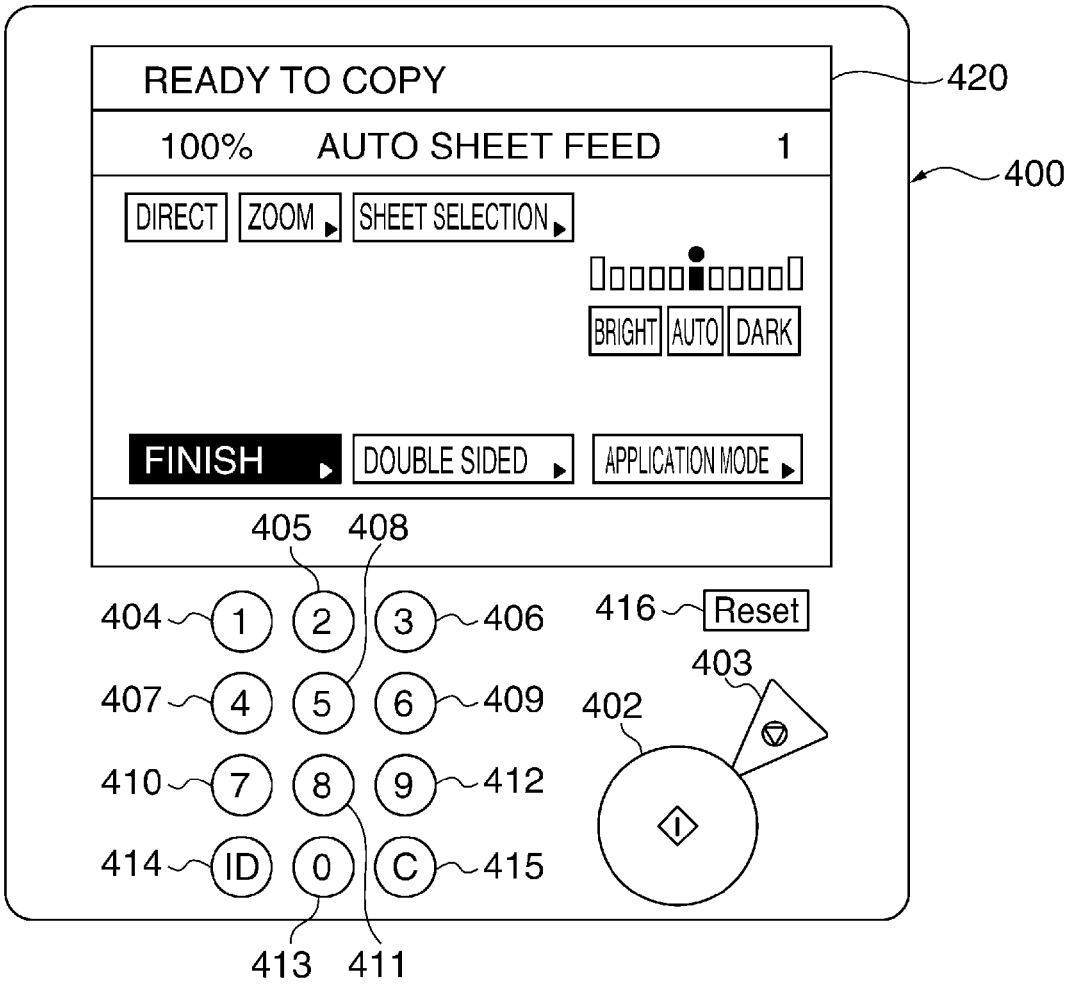
FIG. 3A is a view o a console unit.
Figure 3B:
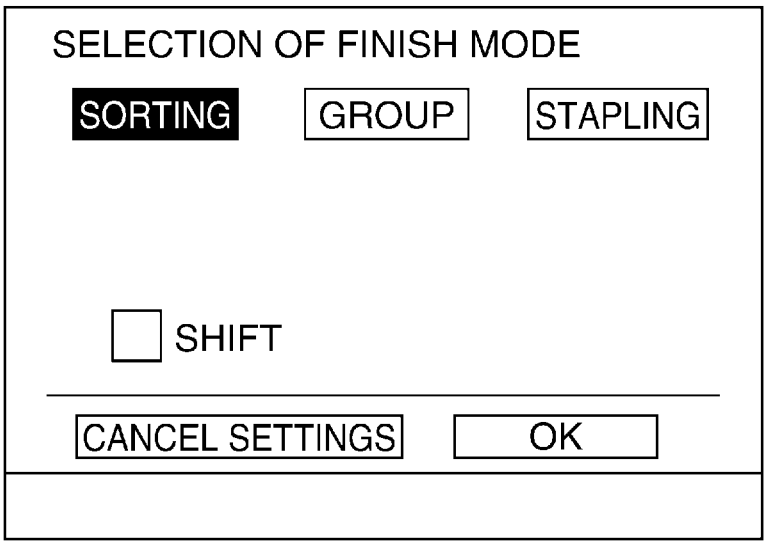
FIG. 3B is a view of an example of display on a display section of the console unit.
Figure 3C:
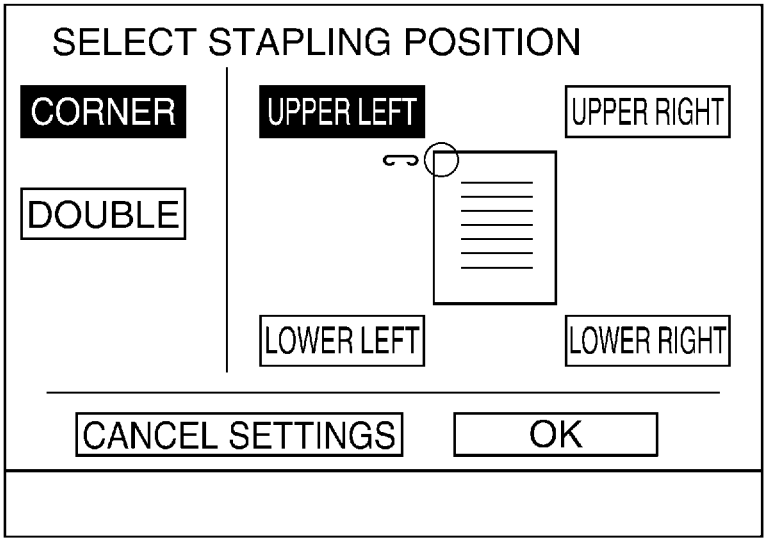
FIG. 3C is a view of another example of display on the display section of the console unit.

FIG. 3A is a view of the console unit 400. On the console unit 400, there are arranged a start key 402 for starting image forming operation, a stop key 403 for interrupting the image forming operation, a ten-key pad including numeric keys 404 to 413 e.g. for entering numbers, an ID key 414, and a clear key 415, a reset key 416, and so forth. Further, the console unit 400 includes the display section 420 having a touch panel provided on the top thereof. Soft keys are arranged on the screen of the display section 420. FIGS. 3B and 3C show examples of display on the display section 420.

The image forming apparatus 10 has a non-sorting mode, a sorting mode, a stapling sorting mode (binding mode), a bookbinding mode, and so forth, as post-processing modes. These processing modes are set or configured by input operations from the console unit 400.

Figure 4:
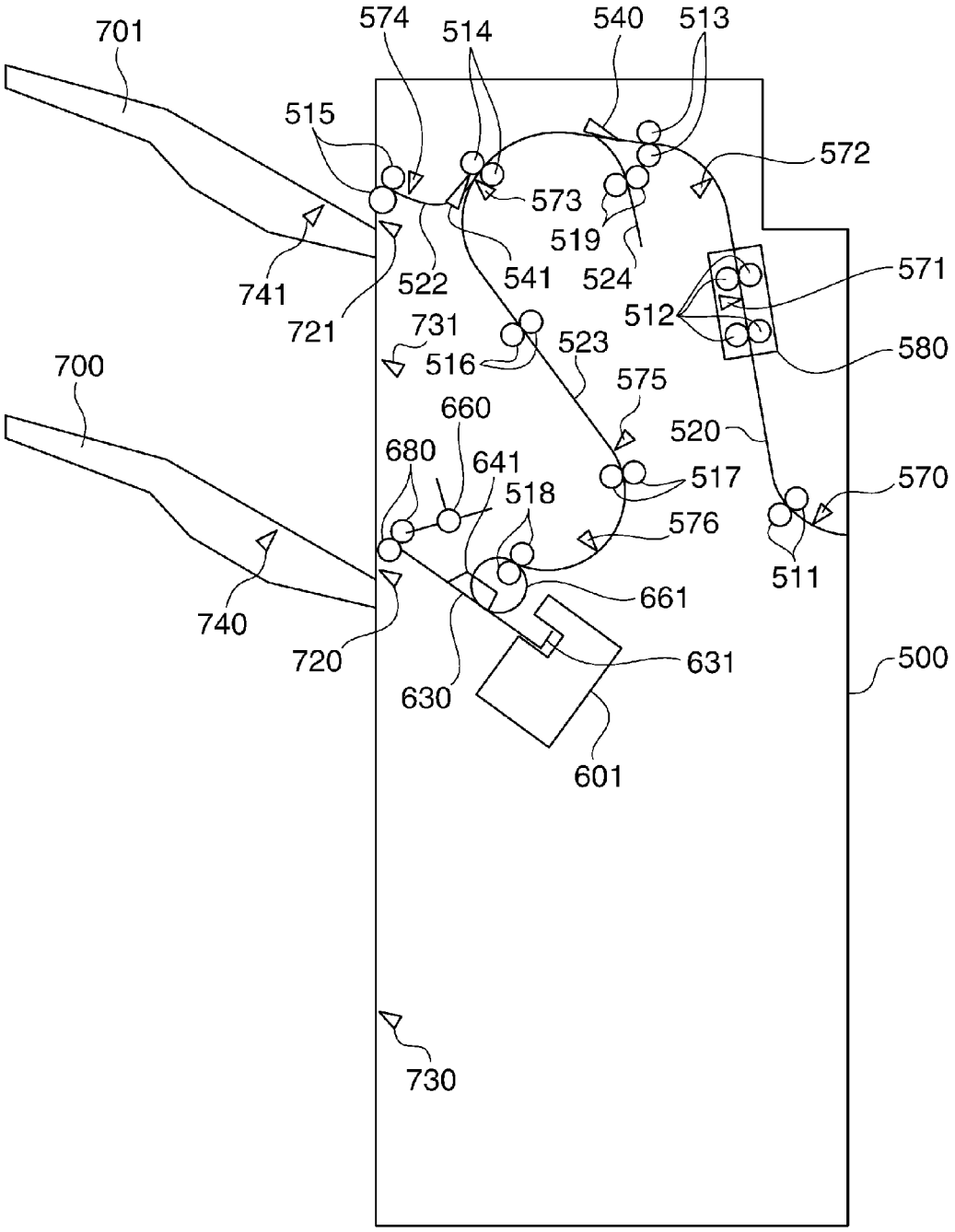
FIG. 4 is a schematic longitudinal cross-sectional view of a finisher.
Figure 5:
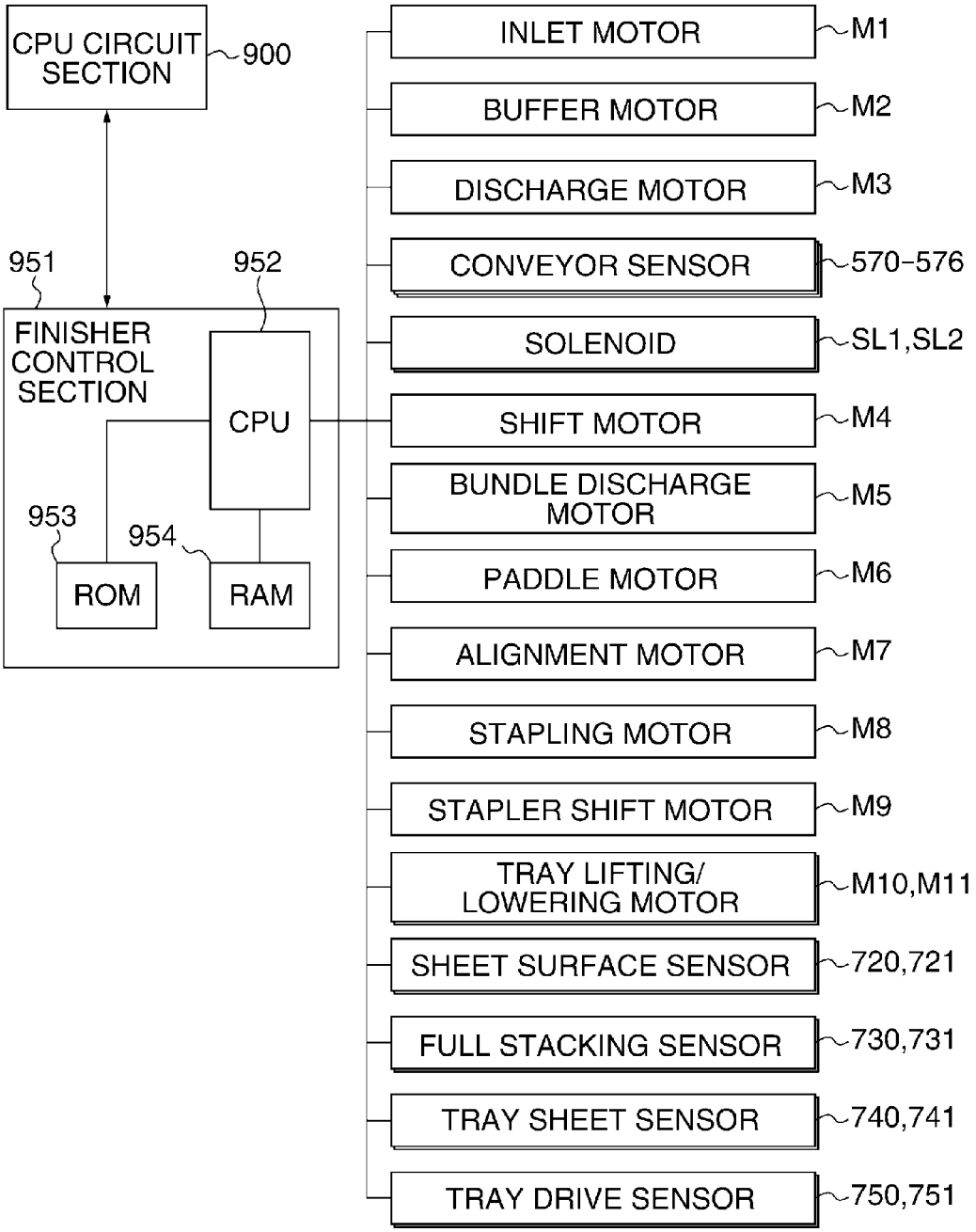
FIG. 5 is a functional block diagram of the finisher.

Next, the arrangement of the finisher 500 will be described with reference to FIGS. 4 and 5. FIG. 4 is a schematic longitudinal cross-sectional view of the finisher 500. FIG. 5 is a functional block diagram of the finisher 500.

The finisher 500 is capable of performing processing for sequentially taking in sheets discharged from the image forming apparatus 10, aligning the sheets, and then making a bundle of the sheets, as post-processing. Further, the finisher 500 is capable of performing other post-processing, such as stapling processing for stapling the trailing end of the sheet bundle by a stapler.

The finisher 500 takes in a sheet discharged from the image forming apparatus 10 into a conveying path 520 by a conveying roller pair 511. The sheet taken in by the conveying roller pair 511 is conveyed by conveying roller pairs 512 and 513.

Between the conveying roller pair 513 and a conveying roller pair 514, there is disposed a switching flapper 540 for guiding a sheet which is inverted and conveyed by the conveying roller pair 514 into a buffer path 524. Between the conveying roller pair 514 and a conveying roller pair 515, there is disposed a switching flapper 541 for switching the sheet conveying path between an upper discharge path 522 and a lower conveying path 523.

When the switching flapper 541 switches the sheet conveying path to the upper discharge path 522, a sheet is guided into the upper discharge path 522 by the conveying roller pair 514 driven by a buffer motor M2 (see FIG. 5). Then, the sheet is discharged onto a stacking tray 701 by the conveying roller pair 515 driven by a discharge motor M3 (see FIG. 5).

When the switching flapper 541 switches the sheet conveying path to the lower conveying path 523, a sheet is guided into the lower conveying path 523 by the conveying roller pair 514 and a conveying roller pair 516 driven by the buffer motor M2 (see FIG. 5). Then, the sheet is guided to a processing tray 630 by conveying roller pairs 517 and 518 driven by the discharge motor M3 (see FIG. 5).

Thereafter, the sheet is discharged onto the processing tray 630 or a stacking tray 700 according to a selected processing mode. When "stapling" is selected by a user, the sheet is discharged onto the processing tray 630, whereas when "stapling" is not selected by the user, the sheet is discharged onto the stacking tray 700 by a bundle discharge roller pair 680 driven by a bundle discharge motor M5 (see FIG. 5).

The sheet discharged onto the processing tray 630 is conveyed backward along the sheet conveying direction by a knurled belt 661 driven in timing synchronous with driving of the conveying roller pair 518 and a paddle 660 driven by a paddle motor M6 (see FIG. 5). The sheet conveyed back is brought into abutment with a stopper 631 of a stapler 601 and is stopped.

A pair of alignment members 641 disposed on the respective front and rear sides, as viewed in FIG. 4, of the processing tray 630 are moved by an alignment motor M7 (see FIG. 5) in a direction orthogonal to the sheet conveying direction (i.e. in the direction of width of the sheet). The alignment members 641 perform alignment processing on sheets stacked on the processing tray 630, and then stapling processing and other processing are performed on the sheets, as required. The sheets bundled e.g. by the stapling processing are discharged as a product onto the stacking tray 700 by the bundle discharge roller pair 680.

Next, a description will be given, with reference to FIG. 5, of the arrangement of the finisher control section 951 that drivingly controls the finisher 500, and its control operation.

As shown in FIG. 5, the finisher control section 951 is comprised of a CPU 952, a ROM 953, and a RAM 954. The finisher control section 951 communicates with the CPU circuit section 900 provided in the image forming apparatus 10 via a communication IC, not shown, for data exchange, and executes various programs stored in the ROM 953 according to instructions from the CPU circuit section 900 to thereby drivingly control the finisher 500.

For various kinds of inputs and outputs, the CPU 952 outputs a control signal to each of motors M1 to M11 including the above-mentioned motors, i.e. an inlet motor M1, the buffer motor M2, the discharge motor M3, a shift motor M4, the bundle discharge motor M5, the paddle motor M6, the alignment motor M7, a stapling motor M8, a stapler shift motor M9, and tray lifting/lowering motors M10 and M11.

The inlet motor M1 drives the conveying roller pairs 511, 512, and 513. The buffer motor M2 drives the conveying roller pair 514 and a conveying roller pair 519. The discharge motor M3 drives the conveying roller pairs 515, 516, 517, and 518. The shift motor M4 drives a shift unit 580.

As motors for driving the respective members of the processing tray 630, the bundle discharge motor M5 drives the bundle discharge roller pair 680, the paddle motor M6 drives the paddle 660, the alignment motor M7 drives the alignment members 641, and the stapling motor M8 drives the stapler 601. The stapler shift motor M9 shifts the stapler 601 along the outer periphery of the processing tray 630.

The stacking trays 700 and 701 are stacking units that can be lifted and lowered independently of each other, and the tray lifting/lowering motors M10 and M11 function as drive units for driving the respective stacking trays 700 and 701. The tray lifting/lowering motors M10 and M11 operate under the control of the CPU 952 to lift and lower the respective stacking trays 700 and 701. That is, the CPU 952 corresponds to a control unit and a drive control unit of the invention.

The CPU 952 receives input signals e.g. from conveyor sensors 570 to 576 disposed in the respective conveying paths so as to detect passage of sheets. Further, the CPU 952 outputs a control signal to each of a solenoid SL1 for driving the switching flapper 540 and a solenoid SL2 for driving the switching flapper 541.

As detection units related to the stacking trays 700 and 701, there are provided sheet surface sensors 720 and 721, full stacking sensors 730 and 731, tray sheet sensors 740 and 741, and tray drive sensors 750 and 751.

Figure 6A:
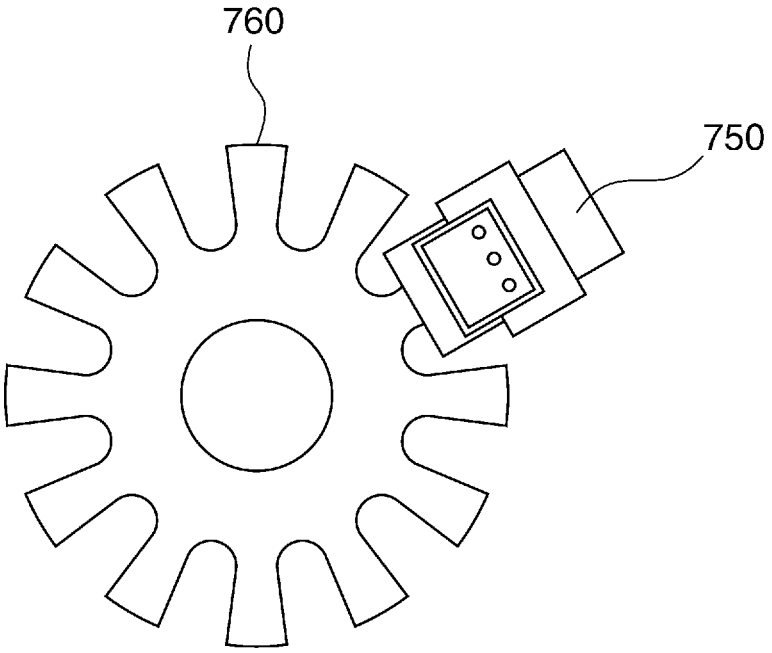
FIG. 6A is a schematic view of a tray drive sensor and an encoder when the tray drive sensor is OFF.
Figure 6B:
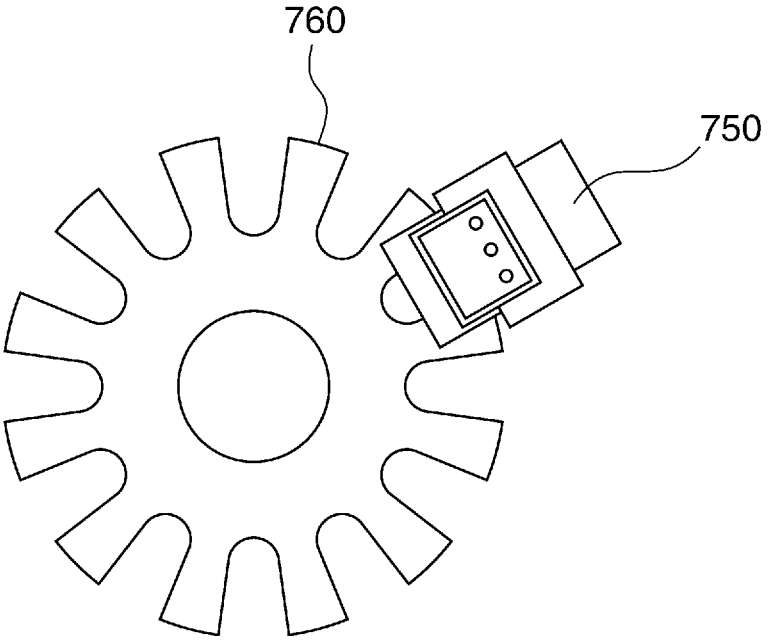

A description will be give, with reference to FIGS. 6A and 6B, of how the tray drive sensor 750 detects lifting/lowering of the stacking tray 700. FIGS. 6A and 6B are schematic views of the tray drive sensor 750.

As shown in FIGS. 6A and 6B, the tray drive sensor 750 is switched off or on whenever the stacking tray 700 lifted or lowered (moved up or down) by a predetermined distance. When the tray lifting/lowering motor M10 is operated under the control of the CPU 952, an encoder 760 is rotated via a pulley, not shown. When the encoder 760 is switched to a state where it does not shield the tray drive sensor 750 (see FIG. 6B), the tray drive sensor 750 is turned on, and when the encoder 760 is switched to a state where it shields the tray drive sensor 750 (see FIG. 6A), the tray drive sensor 750 is turned off. When the rotational speed of the encoder 760 is stabilized to a constant speed, the time interval of ON/OFF switching of the tray drive sensor 750 also becomes substantially constant. The tray drive sensor 751 has the same arrangement as described above for detecting the vertical motion of the stacking tray 701.

The sheet surface sensors 720 and 721 detect the position of the top surface position of respective products (sheet bundles) on the stacking trays 700 and 701. When the top surface positions of the products are higher than the detection positions of the sheet surface sensors 720 and 721, the sheet surface sensors 720 and 721 are shielded to be turned on. The tray sheet sensors 740 and 741 (hereinafter also simply referred to as the sheet sensors 740 and 741) detect presence/absence of respective products on the stacking trays 700 and 701. When a product is detected, an associated one of the tray sheet sensors 740 and 741 is turned on. The full stacking sensors 730 and 731 detect respective fully stacked states of the stacking trays 700 and 701. When a lowered position of each of the stacking trays 700 and 701 is lower than a predetermined position corresponding to a fully stacked position, an associated one of the full stacking sensors 730 and 731 is tuned on. Note that although each of the sensors 720, 721, 740, 741, 730, and 731 is implemented e.g. by an optical sensor, the configuration of each sensor is not particularly limited.

Hereafter, a description will be given of detection and operation related to the stacking tray 700 as a representative of the two stacking trays 700 and 701. The CPU 952 lifts or lowers the stacking tray 700 based on the result of detection by the sheet surface sensor 720 so as to hold the top surface position of products on the stacking tray 700 at an appropriate position (i.e. a predetermined height) with respect to a discharge port. For example, when products are stacked on the stacking tray 700 by an amount corresponding to a predetermined number of sheets, causing the sheet surface sensor 720 to be shielded, the CPU 952 controls the tray lifting/lowering motor M10 to lower the stacking tray 700 to a position at which the products do not shield the sheet surface sensor 720.

On the other hand, when the stacking tray 700 is lowered to a position as high as the position of the full stacking sensor 730, the full stacking sensor 730 is turned on, and the CPU 952 sends full stacking detection information to the image forming apparatus 10 so as to notify the same that the stacking tray 700 has been fully stacked. The image forming apparatus 10 having received the full stacking detection information suspends operation for an image forming job until the products on the stacking tray 700 are removed, and sends back to the finisher 500 a command indicating that the job has been suspended.

Next, a description will be given, with reference to FIGS. 7, 8A, and 8B, of a stacking tray lowering control process performed by the finisher 500, for control of the lowering of the stacking tray 700, including control concerning the detection of an obstacle below the stacking tray 700.

Figure 7:
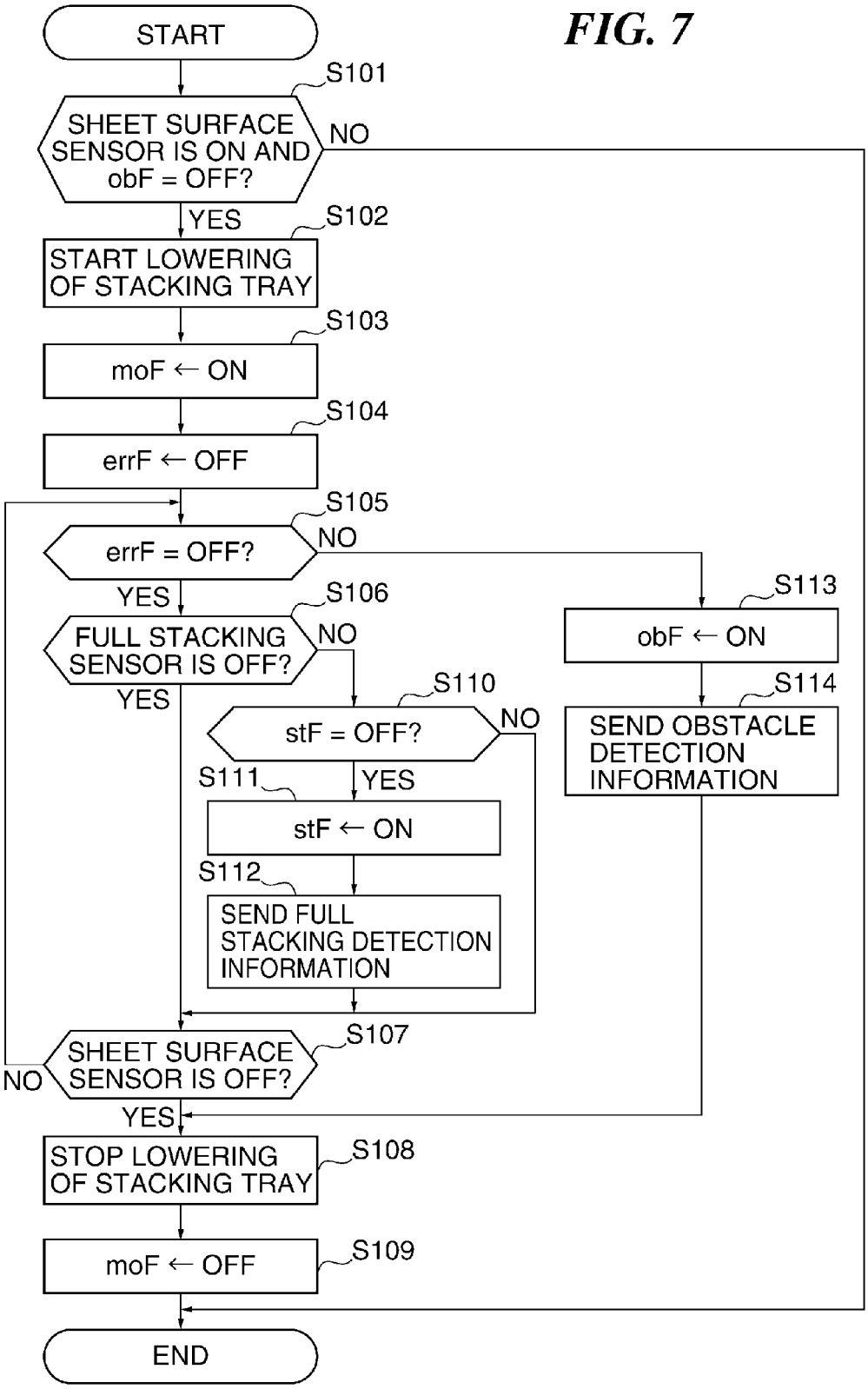
FIG. 7 is a flowchart of a stacking tray lowering control process.

FIG. 7 is a flowchart of the stacking tray lowering control process for controlling the lowering of the stacking tray 700. This process is started when the sheet sensor 740 is turned on.

First of all, flags stored and updated as variables in the RAM 954 in the present process will be described. In the present process, there appear a lowering incapability flag obF, a driving flag moF, an error flag errF, and a full stacking flag stF.

The lowering incapability flag obF is set to ON when the stacking tray 700 cannot be lowered in spite of the CPU 952 attempting to lower the same, and is otherwise set to OFF. As a situation where the lowering incapability flag obF is ON (obF=ON), a case can be envisaged where an obstacle exists below the stacking tray 700 (e.g. on a floor immediately below the same). The driving flag moF is set to ON when the tray lifting/lowering motor M10 is moving the stacking tray 700, and otherwise set to OFF.

The state of the driving flag moF being ON does not always mean that the stacking tray 700 is actually moving. The error flag errF is set to ON when it is determined that some abnormality has occurred to the lifting/lowering operation of the stacking tray 700, and is otherwise set to OFF. Processing for switching the error flag errF on or off will be described hereinafter with reference to FIG. 9. The full stacking flag stF is set to ON when the stack try 700 is lowered to the fully stacked position (i.e. when the lowered position is lower than the predetermined position), and is otherwise set to OFF.

First, in a step S101, the CPU 952 of the finisher 500 determines whether or not the sheet surface sensor 720 is ON and the lowering incapability flag obF is OFF. If it is determined that the sheet surface sensor 720 is ON and the lowering incapability flag obF is OFF, the CPU 952 proceeds to a step S102. In the other cases, it is not required to lower the stacking tray 700, or it has already been determined that an obstacle exists and it is impossible to lower the stacking tray 700, so that the CPU 952 immediately terminates the FIG. 7 process.

In the step S102, the CPU 952 controls the tray lifting/lowering motor M10 to start lowering the stacking tray 700. This places the tray lifting/lowering motor M10 into a driving state, and therefore the CPU 952 sets the driving flag moF to ON (step S103) and the error flag errF to OFF (step S104).

Then, the CPU 952 determines in a step S105 whether or not the error flag errF is OFF. If the error flag errF is OFF (errF=OFF), the CPU 952 proceeds to a step S106 and determines whether or not the full stacking sensor 730 is OFF. If the full stacking sensor 730 is OFF, the CPU 952 proceeds to a step S107, whereas if not, the CPU 952 judges that the stacking tray 700 has reached the fully stacked position and proceeds to a step S110.

In the step S107, the CPU 952 determines whether or not the sheet surface sensor 720 is OFF. If the sheet surface sensor 720 is OFF, the CPU 952 proceeds to a step S108, whereas if not, the CPU 952 returns to the step S105. Therefore, insofar as the error flag is OFF (errF=OFF), lowering of the stacking tray 700 is continued until the sheet surface sensor 720 is turned off.

In the step S110, since the stacking tray 700 has reached the fully stacked position, the CPU 952 determines whether or not the full stacking flag stF is OFF. If the full stacking flag stF is not OFF, which means that the full stacking flag stF has already been turned on, the CPU 952 proceeds to the step S107. On the other hand, if the full stacking flag stF is OFF, the CPU 952 sets the full stacking flag stF to ON (step S111) and sends the full stacking detection information to the CPU circuit section 900 of the image forming apparatus 10 (step S112).

Figure 8A:
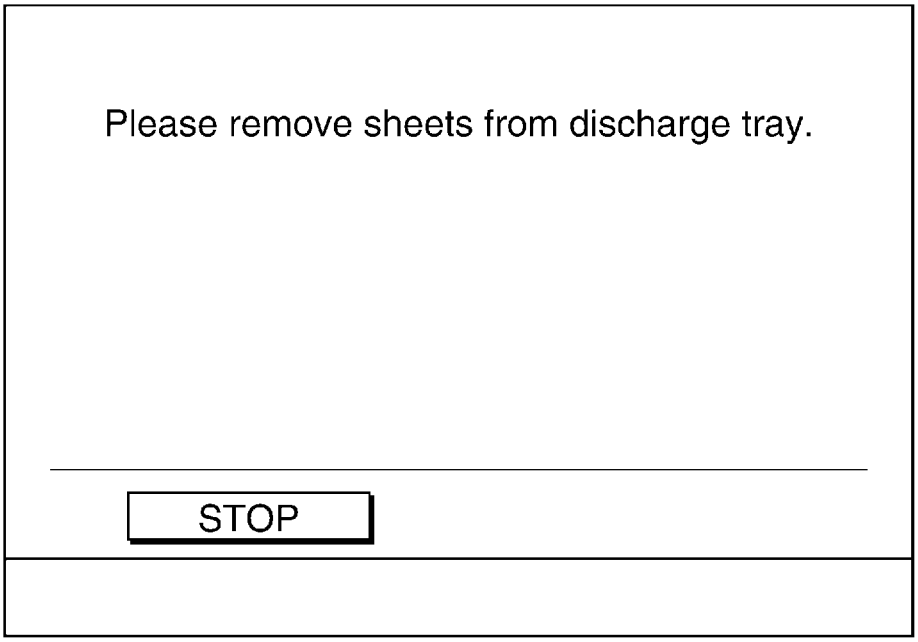
FIG. 8A is a view of an example of display on the display section when full stacking detection information is received.

The CPU circuit section 900 having received the full stacking detection information suspends an image forming operation (suspends the job) and causes the display section 420 of the console unit 400 to display a screen illustrated in FIG. 8A. More specifically, the image forming apparatus 10 suspends the job being currently executed, and the CPU circuit section 900 sends a command indicating that the job has been suspended to the CPU 952 of the finisher 500. After execution of the step S112, the CPU 952 causes the process to proceed to the step S107.

On the other hand, if it is determined in the step S105 that the error flag is not OFF, which means that the error flag errF was switched from OFF to ON during lowering of the stacking tray 700, it can be determined that there is a strong possibility that the stacking tray 700 has become incapable of lowering due to interference of an obstacle. In this case, in a step S113, the CPU 952 sets the lowering incapability flag obF to ON. Further, in a step S114, the CPU 952 sends obstacle detection information to the CPU circuit section 900, and then causes the process to proceed to the step S108. Note that a case where the error flag errF is turned on will be described in detail hereinafter.

Transmission of the full stacking detection information (step S112) and transmission of the obstacle detection information (step S114) both serve to prompt the image forming apparatus 10 to suspend the job. That is, the CPU 952 corresponds to a control unit of the present invention, which is configured to provide notification that a job should be suspended.

Figure 8B:
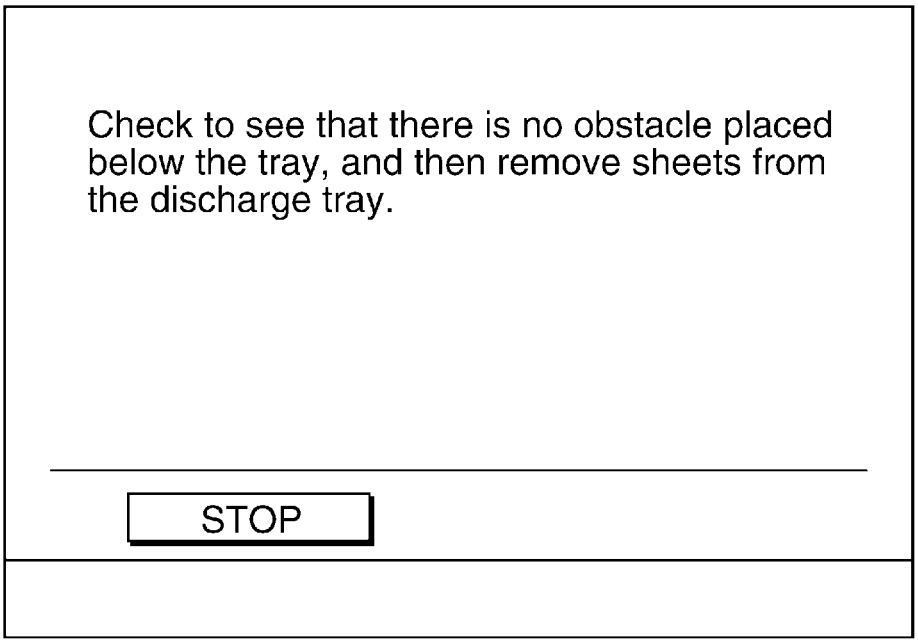
FIG. 8B is a view of an example of display on the display section when obstacle detection information is received.

The CPU circuit section 900 having received the obstacle detection information suspends the image forming operation (suspends the job) and causes the display section 420 of the console unit 400 to display a screen illustrated in FIG. 8B. As is apparent from FIG. 8B, the obstacle detection information also serves as a notification for prompting the user to remove an obstacle. The image forming apparatus 10 suspends the job being currently executed, and the CPU circuit section 900 sends the command indicating that the job has been suspended to the CPU 952 of the finisher 500.

In the step S108, the CPU 952 controls the tray lifting/lowering motor M10 to stop the lowering of the stacking tray 700. Then, the CPU 952 sets the driving flag moF to OFF in a step S109, followed by terminating the FIG. 7 process.

According to the FIG. 7 process, when the stacking tray 700 can be lowered until the sheet surface sensor 720 is turned off, the lowering incapability flag obF is by no means switched on. However, when the error flag errF is switched on (errF=ON) during lowering of the stacking tray 700, it is judged that an obstacle exists below the stacking tray 700, and the lowering incapability flag obF is set to ON. As a consequence, the obstacle detection information is sent to the image forming apparatus 10, and the job is suspended.

Figure 9:
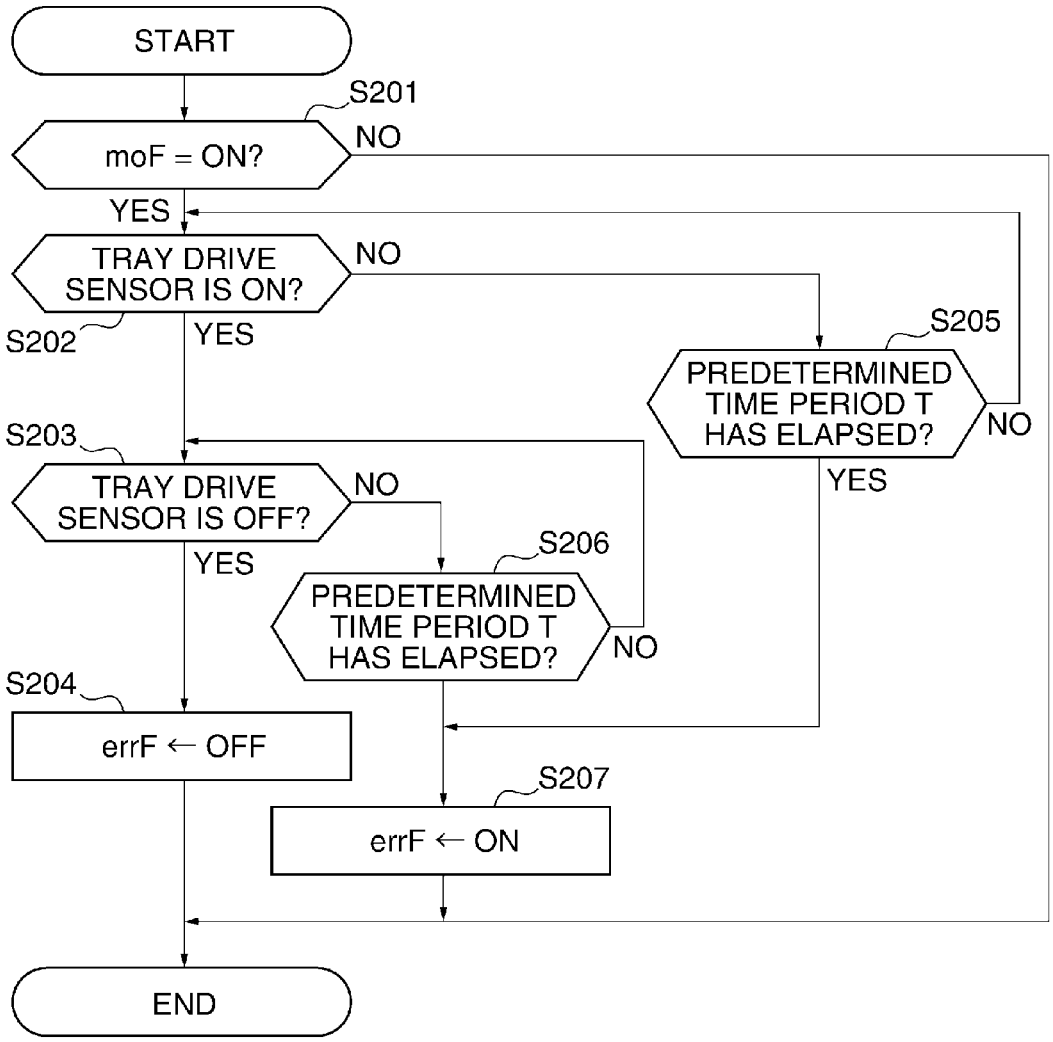
FIG. 9 is a flowchart of an abnormality detection process for lifting and lowering of the stacking tray.

FIG. 9 is a flowchart of an abnormality detection process for lifting and lowering of the stacking tray. This process is executed by the CPU 952 during operation of the finisher 500 at predetermined time intervals so as to determine a state of the stacking tray 700 being moved (i.e. whether or not an abnormality has occurred in lifting or lowering of the stacking tray 700). The state of the stacking tray 700 being moved is a lifted or lowered state of the same.

In the present process, when ON/OFF switching of the tray drive sensor 750 has not occurred over a predetermined time period during the control of the tray lifting/lowering motor M10 for lifting/lowering the stacking tray 700, it is determined that shifting of the stacking tray 700 has been stopped or an abnormality has occurred. That is, the CPU 952 and the tray drive sensor 750 correspond to a determination unit of the present invention, which is configured to determine a state of the stacking tray 700 being moved.

First, in a step S201, the CPU 952 of the finisher 500 determines whether or not the driving flag moF is ON so as to determine whether or not the tray lifting/lowering motor M10 is driving the stacking tray 700. As a result of the determination, if the driving flag moF is not ON, the CPU 952 terminates the FIG. 9 process, whereas if the driving flag moF is ON, the CPU 952 determines in a step S202 whether or not the tray drive sensor 750 is on.

As a result of the determination, if the tray drive sensor 750 is not ON (i.e. is OFF), the CPU 952 determines whether or not a predetermined time period T has elapsed after the tray drive sensor 750 was turned off (i.e. ON/OFF switching of the tray drive sensor 750 occurred) last time (step S205). As a result of the determination, if the predetermined time period T has not elapsed after the tray drive sensor 750 was turned off last time (NO to the step S205), the CPU 952 returns to the step S202.

By the way, as described with reference to FIGS. 6A and 6B, when the moving speed of the stacking tray 700 is constant and stable, the ON/OFF switching of the tray drive sensor 750 occurs at the predetermined time intervals. For this reason, the predetermined time period T is set to a time period slightly longer than the time interval of ON/OFF switching of the tray drive sensor 750.

When the ON/OFF switching of the tray drive sensor 750 occurs before the lapse of the predetermined time period T during repeated execution of the steps S202 and S205, i.e. the tray drive sensor 750 is switched on in the step S202, the CPU 952 causes the process to proceed to a step S203. In this case, it can be judged that the stacking tray 700 is moving normally. However, during repeated execution of the steps S202 and S205, if it is determined in the step S205 that the predetermined time period T has elapsed (YES to the step S205), it is judged that the stacking tray 700 is not moving normally in accordance with driving by the tray lifting/lowering motor M10. More specifically, although the CPU 952 is controlling the tray lifting/lowering motor M10 to lift the stacking tray 700, the stacking tray 700 has not moved for the predetermined time period or longer, and therefore it can be judged that some abnormality has occurred to the tray lifting/lowering motor M10. Based on this judgment, the CPU 952 sets the error flag errF to ON (step S207), followed by terminating the FIG. 9 process.

In the step S203, the CPU 952 determines whether or not the tray drive sensor 750 is OFF. If the tray drive sensor 750 is not OFF (i.e. is ON) (NO to the step S203), the CPU 952 determines whether or not the predetermined time period T has elapsed after the tray drive sensor 750 was turned on (i.e. ON/OFF switching of the tray drive sensor 750 occurred) last time (step S206). If the predetermined time period T has not elapsed after the tray drive sensor 750 was turned on last time (NO to the step S206), the CPU 952 returns to the step S203.

During repeated execution of the steps S203 and S206, if the ON/OFF switching of the tray drive sensor 750 occurs before the lapse of the predetermined time period T, i.e. the tray drive sensor 750 is switched off in the step S203 (YES to the step S203), the CPU 952 proceeds to a step S204. In this case, it can be judged that the stacking tray 700 is moving normally. In the step S204, the CPU 952 sets the error flag errF to OFF, followed by terminating the FIG. 9 process.

However, during repeated execution of the steps S203 and S206, if it is determined in the step S206 that the predetermined time period T has elapsed (YES to the step S206), it is judged that the stacking tray 700 is not moving in accordance with driving by the tray lifting/lowering motor M10. Therefore, it can be judged that some abnormality has occurred to the tray lifting/lowering motor M10, and the CPU 952 sets the error flag errF to ON (step S207), followed by terminating the FIG. 9 process.

Note that although in the above example, measurement of the predetermined time period T is started at a time point when the tray drive sensor 750 was turned on or off last time, the starting point may be set to a time point when the FIG. 9 process is started.

Next, a description will be given, with reference to FIGS. 10 and 11, of resumption of a job suspended based on determination that an obstacle exists below the stacking tray 700 or that the stacking tray 700 has reached the fully stacked position.

Figure 10:
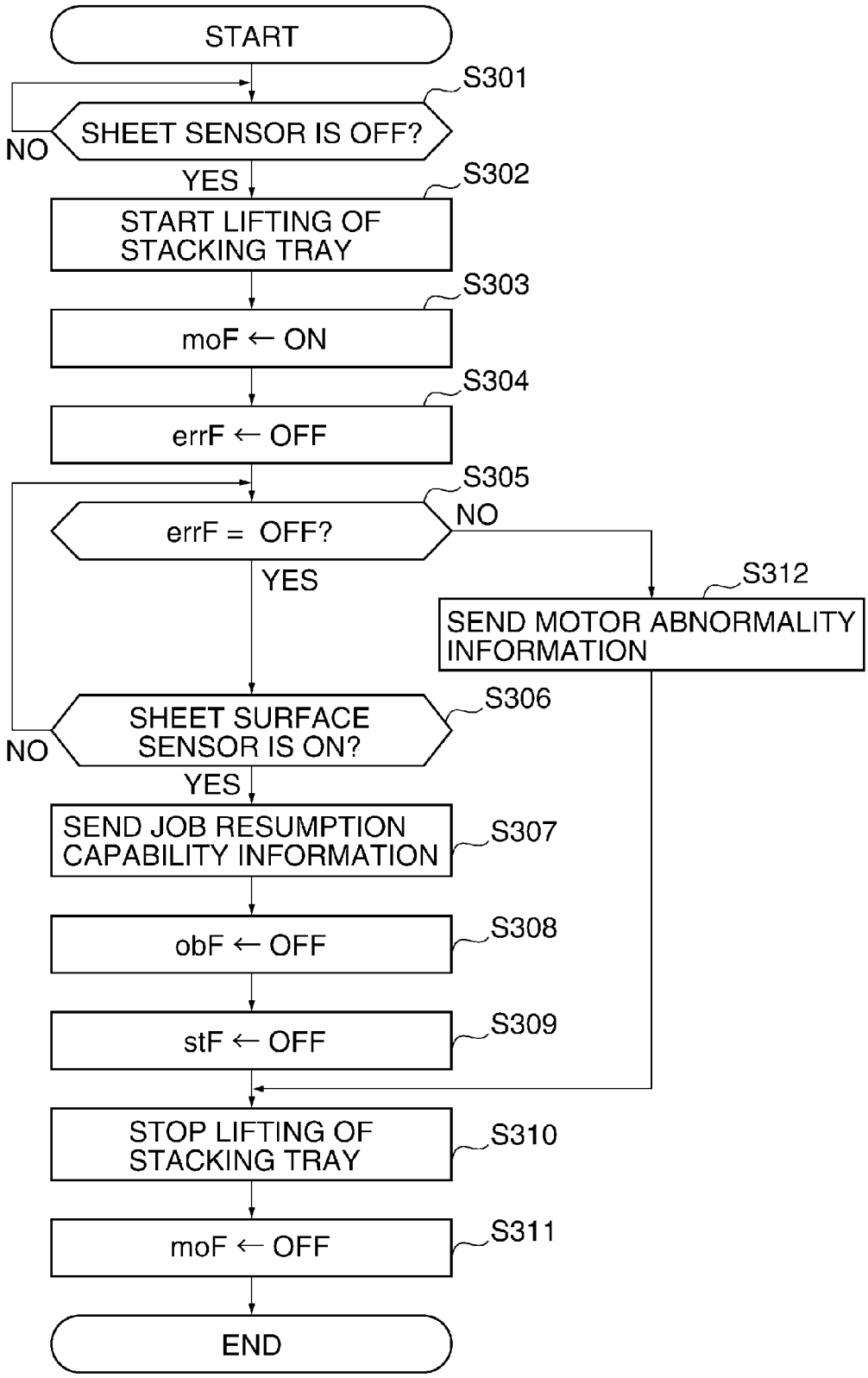
FIG. 10 is a flowchart of a job resumption process.
Figure 11:
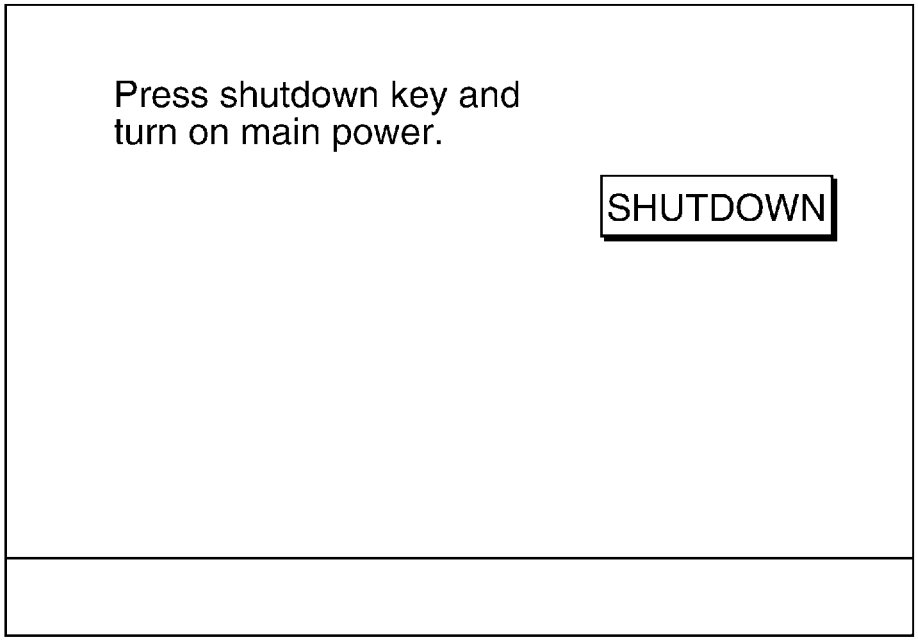
FIG. 11 is a view of an example of display on the console unit when motor abnormality information is received.

FIG. 10 is a flowchart of a job resumption process. This process is executed by the CPU 952 of the finisher 500 and is started when the lowering incapability flag obF is switched on or when the full stacking flag stF is switched on.

First, in a step S301, the CPU 952 determines whether or not the sheet sensor 740 of the stacking tray 700 is off. This step is repeatedly carried out until the sheet sensor 740 is turned off. If the sheet sensor 740 is turned off, which means that products on the stacking tray 700 have been removed, the CPU 952 controls the tray lifting/lowering motor M10 to start lifting the stacking tray 700 (step S302). Further, the CPU 952 sets the driving flag moF to ON (step S303) and the error flag errF to OFF (step S304).

Then, in a step S305, the CPU 952 determines whether or not the error flag errF is OFF. If the error flag errF is ODD, the CPU 952 determines whether or not the sheet surface sensor 720 is ON (step S306). If the sheet surface sensor 720 is not on, the CPU 952 returns to the step S305. Therefore, insofar as the error flag errF is OFF (errF=OFF), lifting of the stacking tray 700 is continued until at least the sheet surface sensor 720 is turned on.

During repeated execution of the steps S305 and S306, if the sheet surface sensor 720 is turned on, it is judged that the stacking tray 700 has been normally lifted up to a required position. In this case, although the lowering incapability flag obF is on (obF=ON), in an attempt to lift the stacking tray 700 to the required position, the error flag errF has not been switched on again. Therefore, it is judged that no abnormality has occurred to the tray lifting/lowering motor M10. In other words, the CPU 952 can judge that it is impossible to lower the stacking tray 700 due to existence of an obstacle below the stacking tray 700. In this case, it can be judged that there is room for continuation of stacking operation within a range where the obstacle does not interfere with the stacking tray 700. That is, the CPU 952 corresponds to a determination unit of the present invention, which is configured to determine that it is possible to resume the job.

Then, the CPU 952 sends job resumption capability information to the CPU circuit section 900 of the image forming apparatus 10 to thereby provide notification that it is possible to resume the job (step S307). That is, the CPU 952 corresponds to a control unit of the present invention, which is configured to provide notification that it is possible to resume the job. In the case of sending the job resumption capability information, the CPU 952 may also send a notification that the tray lifting/lowering motor M10 is free from abnormality. The CPU circuit section 900 having received the job resumption capability information resumes the image forming operation. This causes the image forming apparatus 10 to automatically resume the job.

Thereafter, the CPU 952 sets the lowering incapability flag obF to OFF (step S308) and the full stacking flag stF to OFF (step S309). Further, the CPU 952 controls the tray lifting/lowering motor M10 to stop lifting the stacking tray 700 (step S310) and sets the driving flag moF to OFF (step S311), followed by terminating the FIG. 10 process.

On the other hand, if it is determined in the step S305 that the error flag errF is ON (errF=ON), the CPU 952 causes the process to proceed from the step S305 to a step S312. In this case, it is judged that the stacking tray 700 could not be lifted up to the required position. More specifically, since the error flag errF has been switched on again (errF=ON) as a result of the attempt to lift the stacking tray 700, it is judged that the tray lifting/lowering motor M10 is abnormal. In other words, the CPU 952 can judge that it is impossible to lower the stacking tray 700 due to failure of the tray lifting/lowering motor M10. That is, the CPU 952 corresponds to a determination unit of the present invention, which is configured to determine that it is impossible to resume the job.

Therefore, in the step S312, the CPU 952 sends motor abnormality information to the CPU circuit section 900 of the image forming apparatus 10 to thereby provide notification that the tray lifting/lowering motor M10 is abnormal. The CPU circuit section 900 having received the motor abnormality information causes the display section 420 of the console unit 400 to display a screen illustrated in FIG. 11 so as to prompt the user to restart the system. After execution of the step S312, the process proceeds to the step S310.

As described above, in a case an operational abnormality is detected during lowering of the stacking tray 700 and a job is temporarily stopped, if the stacking tray 700 is properly lifted through an attempt to lift the stacking tray 700, it is judged that the tray lifting/lowering motor M10 is free from abnormality, thereby making it possible to promptly resume the job.

In other words, when it is impossible to lower the stacking tray 700, an attempt to cause the stacking tray 700 to be temporarily lifted makes it possible to approximately determine from a moved state of the stacking tray 700, whether it is impossible to lower the stacking tray 700 due to existence of an obstacle or abnormality of the tray lifting/lowering motor M10.

Therefore, even when a job is suspended due to the lowering incapability flag obF or the full stacking flag stF being switched on, the job can be sometimes automatically resumed through removal of products from the stacking tray 700 by the user.

According to the present embodiment, when a job continues to be suspended (i.e. after having notified that the job should be suspended), the CPU 952 controls the tray lifting/lowering motor M10 to lift the stacking tray 700 (see FIG. 10). Then, based on a determination (ON/OFF of the error flag errF) as to a moved state of the stacking tray 700 at the time, the CPU 952 determines whether or not to resume the job. When the job is to be resumed, the job resumption capability information is sent to the image forming apparatus 10. Thus, even in a case where it is impossible to lower the stacking unit (stacking tray 700) and a job is suspended, if it can be determined through an attempt to lift the stacking unit that the job can be resumed, it is possible to notify the image forming apparatus 10 that the job is to be resumed to thereby cause the image forming apparatus 10 to resume the job. This makes it possible to eliminate wasteful downtime when it is determined that the job can be continued.

Further, in the case of notifying the image forming apparatus 10 that the job is to be suspended, the CPU 952 also sends a notification prompting the user to remove an obstacle (see FIG. 8B), and hence it is possible to promptly solve the problem of incapability of lowering of the stacking tray 700 by existence of the obstacle.

Furthermore, in a case where it is determined, based on the determination as to a moved state of the stacking tray 700, that the job is not to be resumed, the CPU 952 notifies the image forming apparatus 10 that the tray lifting/lowering motor M10 is abnormal, so that it is possible to prompt the user to execute appropriate processing for normalization without wasting time.

Next, a second embodiment of the invention is described. The second embodiment distinguished from the first embodiment in the job resumption process, and the same configuration as that of the first embodiment in the other respects. Therefore, the second embodiment will be described with reference to FIGS. 12 and 13 in stead of FIGS. 10 and 11.

Figure 12:
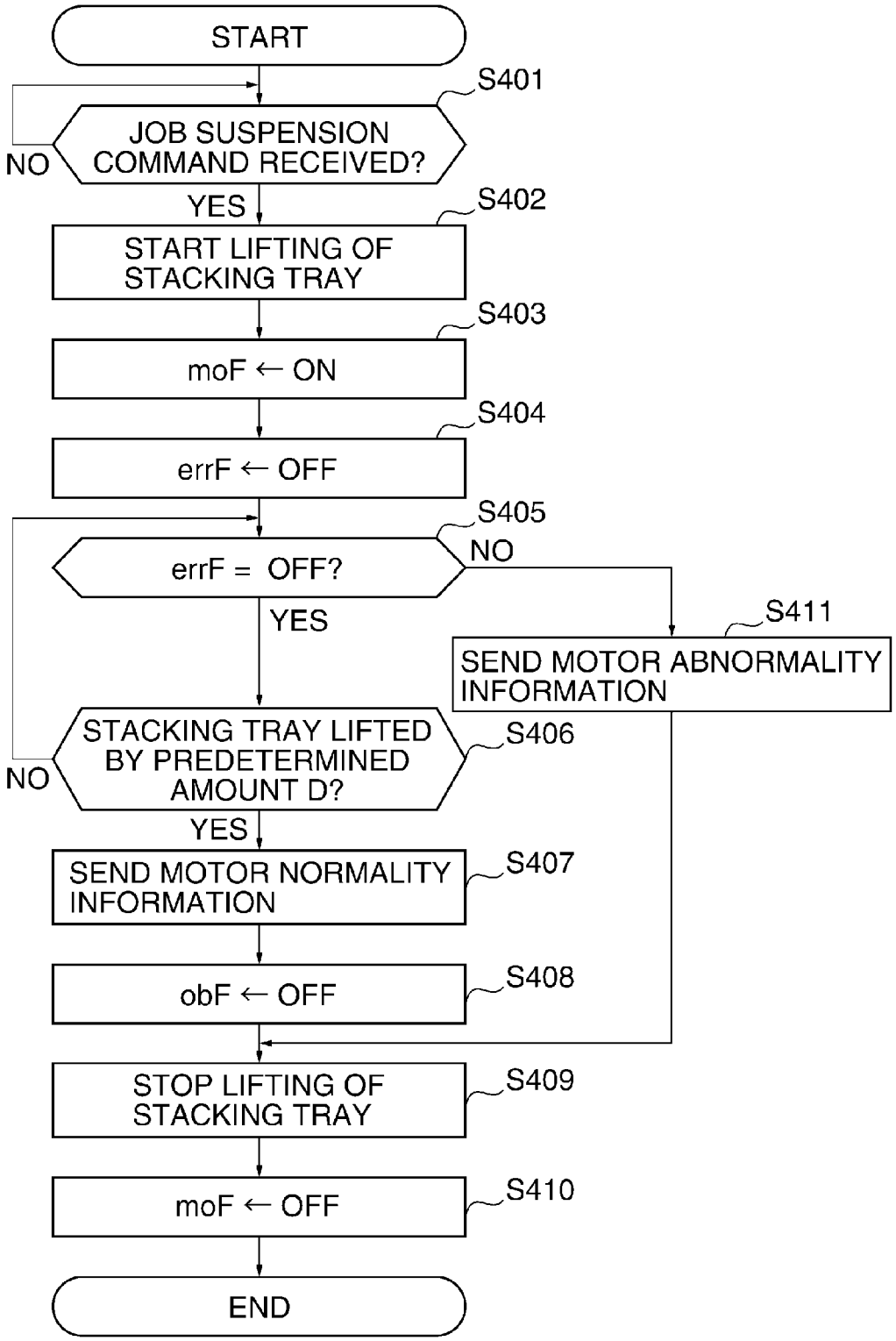
FIG. 12 is a flowchart of a job resumption process performed by an image forming system including a sheet stacking apparatus according to a second embodiment of the invention.

FIG. 12 is a flowchart of a job resumption process performed by the second embodiment. This process is performed by the CPU 952 of the finisher 500 and is started when the lowering incapability flag obF is switched on.

First, in a step S401, the CPU 952 of the finisher 500 determines whether or not a job suspension command indicative of suspension of a job has been received from the CPU circuit section 900 of the image forming apparatus 10. The CPU 952 repeatedly carries out the step S401 until the job suspension command is received. When the job suspension command is received, in steps S402 to S405, the CPU 952 performs the same processing as in the steps S302 to S305. That is, CPU 952 starts lifting of the stacking tray 700, sets the driving flag moF to ON, and sets the error flag errF to OFF.

If it is determined in the step S405 that the error flag errF is OFF, the CPU 952 determines whether or not the stacking tray 700 has been lifted by a predetermined amount D after the start of the lifting (step S406). Note that the predetermined amount D may be set to a fixed value or alternatively may be input by the user in advance.

If it is determined in the step S406 that the stacking tray 700 has not been lifted by the predetermined amount D, the CPU 952 returns to the step S405. Thus, insofar as the error flag errF is OFF (errF=OFF), lifting of the stacking tray 700 is continued until the stacking tray 700 is lifted by at least the predetermined amount D.

During repeated execution of the steps S405 and S406, if the stacking tray 700 has been lifted by the predetermined amount D, it means that although the lowering incapability flag obF is on (obF=ON), the stacking tray 700 could be lifted by the predetermined amount D without the error flag errF being switched on again. Therefore, in this case, it is judged that the tray lifting/lowering motor M10 is free from abnormality. In other words, the CPU 952 can judge that it is impossible to lower the stacking tray 700 due to existence of an obstacle below the stacking tray 700. In this case, it can be judged that there is room for continuing the stacking operation within a range where the obstacle does not interfere with the stacking tray 700.

Then, the CPU 952 sends motor normality information to the CPU circuit section 900 of the image forming apparatus 10 to thereby provide notification that the tray lifting/lowering motor M10 is free from abnormality (step S407). The motor normality information includes information indicating that it is possible to resume the job. That is, the CPU 952 corresponds to the control unit of the invention, which is configured to notify that it is possible to resume the job.

Figure 13:
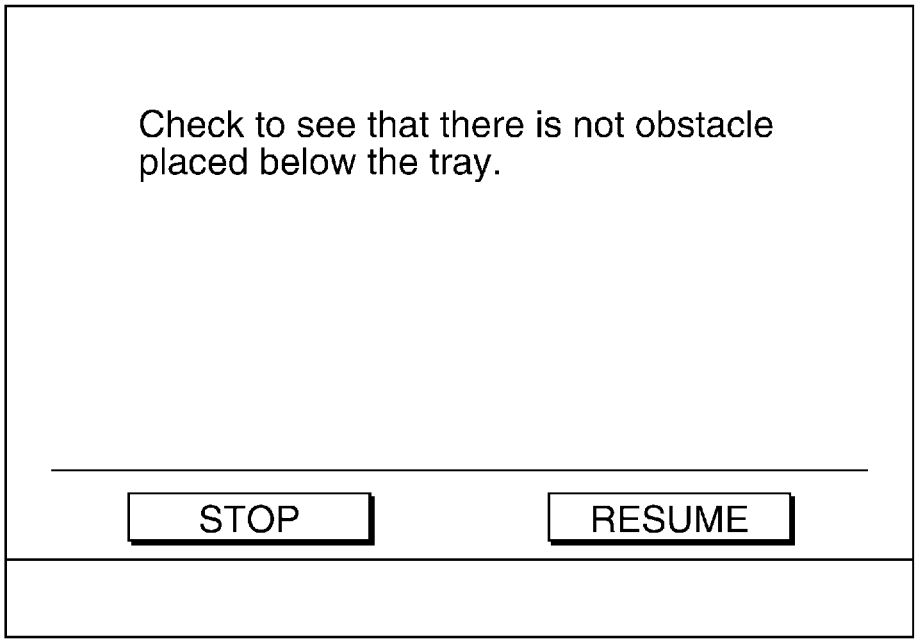
FIG. 13 is an example of display on the console unit when motor normality information is received.
Figure 14:
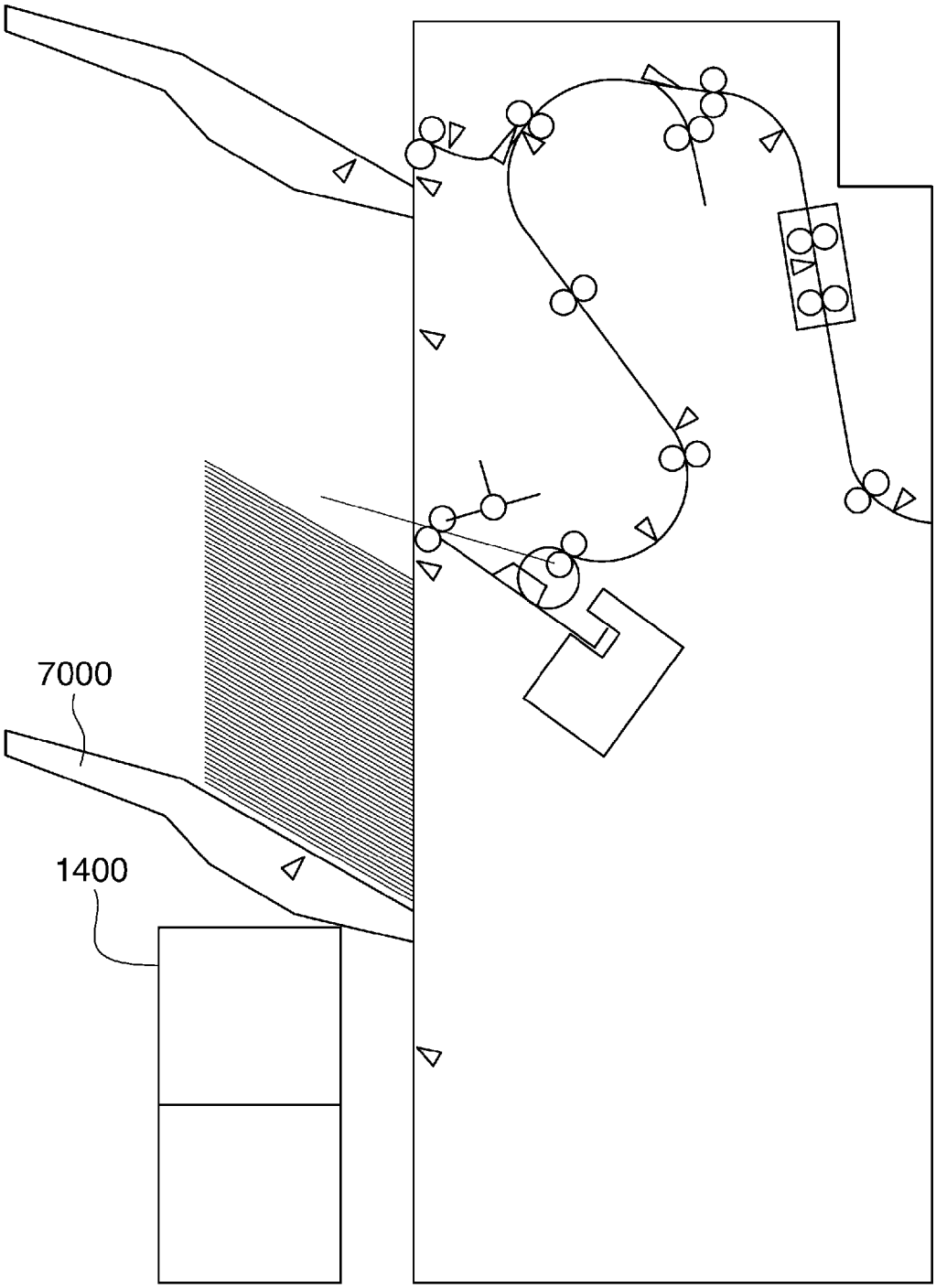
FIG. 14 RELATED ART
FIG. 14 is a view of a conventional sheet processing apparatus in a state where an obstacle is placed below a stacking tray thereof.

The CPU circuit section 900 having received the motor normality information causes the display section 420 of the console unit 400 to display a screen illustrated in FIG. 13 for prompting the user to resume the job. Then, if the user presses a resumption key on the screen in FIG. 13, the CPU circuit section 900 resumes the suspended job. Alternatively, if the user presses a stop key, the CPU circuit section 900 deletes the suspended job. Note that the motor normality information may be configured as information for causing the CPU circuit section 900 to automatically resume the job in the image forming apparatus 10. In this case, the job is automatically resumed in the image forming apparatus 10 without awaiting user input operation. That is, the CPU circuit section 900 corresponds to a control unit of the invention.

In a step S411, the CPU 952 performs the same processing as in the step S312 in FIG. 10. In steps S408, S409, and S410, the CPU 952 performs the same processing as in the steps S308, S310, and S311 in FIG. 10.

According to the present embodiment, it is possible to provide the same advantageous effects as provided by the first embodiment in that even when it has become impossible to lower the stacking unit (stacking tray 700) and a job is suspended, the job can be resumed insofar as it can be determined, through an attempt to lift the stacking unit, that it is possible to resume the job.

Note that in the first embodiment, the step S307 in FIG. 10 may be configured, similarly to the step S407 in FIG. 12, such that the user is prompted to resume the job and the job is resumed when the user inputs a resumption instruction.

Further, the CPU 952 is required to be capable of determining only a moved state of the stacking tray 700 from the result of detection by the tray drive sensor 750, the configuration of the tray drive sensor 750 is not limited to that described with reference to FIGS. 6A and 6B. For example, the tray drive sensor 750 may be a sensor capable of detecting the position and moving speed or moving acceleration of the stacking tray 700 or a simple one configured to only detect whether the stacking tray 700 is moving or stationary. The type of the sensor is not particularly limited, but it may be optical, magnetic, or another type.

Furthermore, although in each of the above-described embodiments, the image forming system is comprised of two separate apparatuses, i.e. the image forming apparatus 10 and the finisher 500, the two apparatuses may be integrally formed as a single apparatus. In this case, the apparatus may be one identified as an image forming apparatus or one identified as a sheet stacking apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

Other Embodiments

This application claims the benefit of Japanese Patent Application No. 2014-091348 filed Apr. 25, 2014 which is hereby incorporated by reference herein in its entirety.

What is claimed is:

1. A sheet stacking apparatus on which sheets received from an image forming apparatus are stacked, the sheet stacking apparatus comprising:

a stacking unit that stacks sheets thereon;

a drive unit configured to drive said stacking unit to be lifted and lowered;

a determination unit configured to determine a lifted or lowered state of said stacking unit; and a control unit configured to:

in a case where said determination unit determines that said stacking unit is not lowered when said control unit controls said drive unit to lower said stacking unit, notify the image forming apparatus that a job should be suspended and control said drive unit to lift said stacking unit; and in a case where, after said determination unit determines that said stacking unit is not lowered and said control unit starts to control said drive unit to lift said stacking unit, said determination unit determines that said stacking unit is lifted by a predetermined amount, notify the image forming apparatus that the job is to be resumed.

2. The sheet stacking apparatus according to claim 1, wherein in a case where said control unit controls said drive unit to lift said stacking unit after said determination unit determines that said stacking unit is not lowered, when said determination unit determines that said stacking unit is not lifted, said control unit is configured to notify the image forming apparatus that said drive unit is abnormal.

3. The sheet stacking apparatus according to claim 1, further comprising:

a first detection unit configured to detect a top surface position of the sheets on said stacking unit, wherein in a case where, after said determination unit determines that said stacking unit is not lowered and said control unit starts to control said drive unit to lift said stacking unit, said first detection unit detects that the top surface position of the sheets has reached a predetermined height without said determination unit determining that said stacking unit is not lifted, said control unit is configured to notify the image forming apparatus that the job is to be resumed.

4. The sheet stacking apparatus according to claim 3, wherein in a case where, after said determination unit determines that said stacking unit is not lowered and said control unit starts to control said drive unit to lift said stacking unit , said determination unit determines that said stacking unit is not lifted before said first detection unit detects that the top surface position of the sheets has reached the predetermined height, said control unit is configured to notify said drive unit is abnormal.

5. The sheet stacking apparatus according to claim 3, further comprising:

a second detection unit configured to detect whether or not the sheets exist on said stacking unit, wherein in a case where said second detection unit detects, after said determination unit determines that said stacking unit is not lowered, that the sheets are removed from said stacking unit, said control unit is configured to start to control said drive unit to lift said stacking unit.

6. The sheet stacking apparatus according to claim 1, further comprising:

a third detection unit configured to detect that a lowered position of said stacking unit is lower than a predetermined position, wherein in a case where said third detection unit detects that the lowered position of said stacking unit is lower than the predetermined position, said control unit is configured to notify the image forming apparatus that the job should be suspended.

7. The sheet stacking apparatus according to claim 1, wherein in a case where, after said determination unit determines that said stacking unit is not lowered and said control unit starts to control said drive unit to lift said stacking unit, said determination unit determines that said stacking unit is not lifted by the predetermined amount, said control unit is configured to notify the image forming apparatus that said drive unit is abnormal.

8. The sheet stacking apparatus according to claim 1, wherein in a case where said control unit receives, after said determination unit determines that said stacking unit is not lowered, a notification that the job has been suspended, from the image forming apparatus, said control unit is configured to start to control said drive unit to lift said stacking unit.

9. The sheet stacking apparatus according to claim 1, wherein in a case where said stacking unit has continued not to be moved for a predetermined time period or longer in spite of said control unit controlling said drive unit to lower said stacking unit, said determination unit is configured to determine that said stacking unit is not lowered.

10. The sheet stacking apparatus according to claim 1, wherein in a case where said stacking unit has continued not to be lifted for a predetermined time period or longer in spite of said control unit controlling said drive unit to lift said stacking unit after said determination unit determines that said stacking unit is not lowered, said determination unit is configured to determine that said stacking unit is not lifted.

11. The sheet stacking apparatus according to claim 1, wherein in a case where said control unit notifies the image forming apparatus that the job should be suspended, said control unit is also configured to provide a notification for prompting removal of an obstacle from below said stacking unit.

12. The sheet stacking apparatus according to claim 1, wherein in a case where said control unit notifies the image forming apparatus that the job can be resumed, said control unit is also configured to notify the image forming apparatus that said drive unit is free from abnormality.

13. A sheet stacking apparatus on which sheets received from an image forming apparatus are stacked, the sheet stacking apparatus comprising:

a stacking unit that stacks sheets thereon;

a drive unit configured to drive said stacking unit to be lifted and lowered;

a determination unit configured to determine a lifted or lowered state of said stacking unit; and a control unit configured to:

in a case where said determination unit determines that said stacking unit is not lowered when said control unit controls said drive unit to lower said stacking unit, control said drive unit to lift said stacking unit;

in a case where, after said determination unit determines that said stacking unit is not lowered and said control unit starts to control said drive unit to lift said stacking unit, said determination unit determines that said stacking unit is not lifted, said drive unit is abnormal; and in a case where, after said determination unit determines that said stacking unit is not lowered and said control unit starts to control said drive unit to lift said stacking unit, said determination unit determines that said stacking unit is lifted, and provides a notification for prompting a user to check whether or not there is an obstacle below the stacking unit.

14. An image forming apparatus comprising:

an image forming unit configured to form an image on a sheet based on an input job;

a stacking unit that stacks thereon sheets each having an image formed thereon by said image forming unit;

a drive unit configured to drive said stacking unit to be lifted and lowered;

a determination unit configured to determine a lifted or lowered state of said stacking unit; and a control unit configured to:

in a case where said determination unit determines that said stacking unit is not lowered when said control unit controls said drive unit to lower said stacking unit, suspend the job and control said drive unit to lift said stacking unit; and in a case where, after said determination unit determines that said stacking unit is not lowered and said control unit starts to control said drive unit to lift said stacking unit, said determination unit determines that said stacking unit is lifted by a predetermined amount, resume the job.

* * * * *